US009955278B2

(12) United States Patent
Fersch et al.

(10) Patent No.: US 9,955,278 B2
(45) Date of Patent: Apr. 24, 2018

(54) EXPLOITING METADATA REDUNDANCY IN IMMERSIVE AUDIO METADATA

(71) Applicant: Dolby International AB, Amsterdam Zuidoost (NL)

(72) Inventors: Christof Fersch, Neumarkt (DE); Heiko Purnhagen, Sundbyberg (SE); Jens Popp, Nuremberg (DE); Martin Wolters, Nuremberg (DE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 15/114,383

(22) PCT Filed: Apr. 1, 2015

(86) PCT No.: PCT/EP2015/057231

§ 371 (c)(1),
(2) Date: Jul. 26, 2016

(87) PCT Pub. No.: WO2015/150480

PCT Pub. Date: Oct. 8, 2015

(65) Prior Publication Data

US 2017/0013387 A1 Jan. 12, 2017

Related U.S. Application Data

(60) Provisional application No. 61/974,349, filed on Apr. 2, 2014, provisional application No. 62/136,786, filed on Mar. 23, 2015.

(51) Int. Cl.

| | |
|---|---|
| ***H04S 3/00*** | (2006.01) |
| ***G10L 19/008*** | (2013.01) |
| ***H04S 7/00*** | (2006.01) |

(52) U.S. Cl.
CPC ..... *H04S 7/30* (2013.01); *G10L 19/008* (2013.01); *H04S 3/008* (2013.01); *H04S 2400/03* (2013.01); *H04S 2400/11* (2013.01); *H04S 2400/13* (2013.01)

(58) Field of Classification Search
CPC ..... H04S 7/30; H04S 3/008; H04S 2400/13; H04S 2400/03; H04S 2400/11; G10L 19/008; G10L 19/00
See application file for complete search history.

(56) References Cited

U.S. PATENT DOCUMENTS

| | | | |
|---|---|---|---|
| 8,184,024 | B2 | 5/2012 | Kameyama |
| 8,340,096 | B2 | 12/2012 | Lee |

(Continued)

FOREIGN PATENT DOCUMENTS

| | | |
|---|---|---|
| EP | 2273492 | 1/2011 |
| KR | 2010-0000846 | 1/2010 |

(Continued)

OTHER PUBLICATIONS

"Dolby Digital Professional Encoding Guidelines" Jan. 1, 2000, pp. 1-174.

*Primary Examiner* — Curtis Kuntz
*Assistant Examiner* — Kenny Truong

(57) ABSTRACT

The present document relates to the field of encoding and decoding of audio. In particular, the present document relates to encoding and decoding of an audio scene comprising audio objects. A method (400) for encoding metadata relating to a plurality of audio objects (106*a*) of an audio scene (102) is described. The metadata comprises a first set (114, 314) of metadata and a second set (104) of metadata. The first and second sets (104, 114, 314) of metadata comprise one or more data elements which are indicative of a property of an audio object (106*a*) from the plurality of audio objects (106*a*) and/or of a downmix signal (112)

(Continued)

derived from the plurality of audio objects (106*a*). The method (400) comprises identifying (401) a redundant data element which is common to the first and second sets (104, 114, 314) of metadata. Furthermore, the method comprises encoding (402) the redundant data element of the first set (114, 314) of metadata by referring to a redundant data element of a set (104) of metadata external for the first set (114, 314) of metadata.

19 Claims, 4 Drawing Sheets

(56) References Cited

U.S. PATENT DOCUMENTS

| | | | | |
|---|---|---|---|---|
| 8,355,509 | B2 | 1/2013 | Faller | |
| 8,396,577 | B2 | 3/2013 | Kraemer | |
| 8,463,413 | B2 | 6/2013 | Oh | |
| 8,644,970 | B2 | 2/2014 | Oh | |
| 8,660,999 | B2 | 2/2014 | Cho | |
| 2003/0101162 | A1* | 5/2003 | Thompson | G06F 17/30097 |
| 2009/0265164 | A1 | 10/2009 | Yoon | |
| 2010/0014679 | A1* | 1/2010 | Kim | G10L 19/008 381/23 |
| 2011/0040395 | A1* | 2/2011 | Kraemer | G10L 19/00 700/94 |
| 2013/0322633 | A1* | 12/2013 | Stone | H04S 3/00 381/2 |
| 2014/0086416 | A1* | 3/2014 | Sen | G10L 19/008 381/23 |
| 2014/0355767 | A1* | 12/2014 | Virette | G10L 19/008 381/22 |

FOREIGN PATENT DOCUMENTS

| | | |
|---|---|---|
| WO | 2007/091870 | 8/2007 |
| WO | 2012/122397 | 9/2012 |

* cited by examiner

EXPLOITING METADATA REDUNDANCY IN IMMERSIVE AUDIO METADATA

CROSS-REFERENCE TO RELATED APPLICATIONS

This application claims the benefit of priority to U.S. Provisional Patent Application No. 61/974,349 filed 2 Apr. 2014 and U.S. Provisional Patent Application No. 62/136,786 filed 23 Mar. 2015, which are hereby incorporated by reference.

TECHNICAL FIELD

The present document relates to the field of encoding and decoding of audio. In particular, the present document relates to encoding and decoding of an audio scene comprising audio objects.

BACKGROUND

The advent of object-based audio has significantly increased the amount of audio data and the complexity of rendering this data within high-end playback or rendering systems. For example, cinema sound tracks may comprise many different sound elements corresponding to images on the screen, dialog, noises, and sound effects that emanate from different places on the screen and combine with background music and ambient effects to create the overall auditory experience. Accurate playback by a renderer requires that sounds be reproduced in a way that corresponds as closely as possible to what is shown on screen with respect to sound source position, intensity, movement, and depth. Object-based audio represents a significant improvement over traditional channel-based audio systems that send audio content in the form of speaker feeds to individual speakers in a listening environment, and are thus relatively limited with respect to spatial playback of specific audio objects.

In order to make object-based audio (also referred to as immersive audio) backward-compatible with channel-based rendering devices and/or in order to reduce the data rate of object-based audio, it may be beneficial to perform a downmix of some or all of the audio objects into one or more audio channels, e.g. into 5.1 or 7.1 audio channels. The downmix channels may be provided along with metadata which describes the properties of the original audio objects, and which allows a corresponding audio decoder to recreate (an approximation of) the original audio objects.

Furthermore, so called unified object and channel coding systems may be provided which are configured to process a combination of object-based audio and channel-based audio. Unified object and channel encoders typically provide metadata which is referred to as side information (sideinfo) and which may be used by a decoder to perform a parameterized upmix of one or more downmix channels to one or more audio objects. Furthermore, unified object and channel encoders may provide object audio metadata (referred to herein as OAMD) which may describe the position, the gain and other properties of an audio object, e.g. of an audio object which has been re-created using the parameterized upmix.

As indicated above, unified object and channel encoders (also referred to as immersive audio encoding systems) may be configured to provide a backward-compatible multichannel downmix (e.g. a 5.1 channel downmix). The provision of such a backward-compatible downmix is beneficial, as it allows for the use of low complexity decoders in legacy playback systems. Even if the downmix channels which have been generated by the encoder are not directly backward-compatible, additional downmix metadata may be provided which allows the downmix channels to be transformed into backward-compatible downmix channels, thereby allowing the use of low complexity decoders for the playback of the audio within a legacy playback system. This additional downmix metadata may be referred to as "SimpleRendererInfo".

As such, an immersive audio encoder may provide various different types or sets of metadata. In particular, an immersive audio encoder may encode up to three (or more) types or sets of metadata (sideinfo, OAMD and SimpleRendererInfo) into a single bitstream. The provision of different types or sets of metadata provides flexibility with regards to the type of decoder which receives and which decodes the bitstream. On the other hand, the provision of different sets of metadata leads to a substantial increase of the data rate of a bitstream.

In view of the above, the present document addresses the technical problem of reducing the data rate of the metadata which is generated by an immersive audio encoder.

SUMMARY

According to an aspect a method for encoding metadata relating to a plurality of audio objects of an audio scene is described. The method may be executed by an immersive audio encoder which is configured to generate a bitstream from the plurality of audio objects. An audio object of the plurality of audio objects may relate to an audio signal emanating from a source within a three dimensional (3D) space. One or more properties of the source of the audio signal (such as the spatial position of the source (as a function of time), the width of the source (as a function of time), a gain/strength of the source (as a function of time)) may be provided as metadata (e.g. within one or more data elements) along with the audio signal.

In particular, the metadata comprises a first set of metadata and a second set of metadata. By way of example, the first set of metadata may comprise side information (sideinfo) and/or additional downmix metadata (SimpleRendererInfo) as described in the present document. The second set of metadata may comprise object audio metadata (OAMD) or personalized object audio metadata as described in the present document.

At least one of the first and second sets of metadata may be associated with a downmix signal derived from the plurality of audio objects. By way of example, an audio encoder may comprise a downmix unit which is configured to generate M downmix audio signals from N audio objects of the audio scene (M<N). The downmix unit may be configured to perform an adaptive downmix, such that each downmix audio signal may be associated with a channel or speaker, wherein a property (e.g. a spatial position, a width, a gain/strength) of the channel or speaker may vary in time. The varying property may be described by the first and/or second set of metadata (e.g. by the first set of metadata, such as the side information and/or the additional downmix metadata).

As such, the first and second sets of metadata may comprise one or more data elements which are indicative of a property of an audio object from the plurality of audio objects (e.g. of the source of an audio signal) and/or of the downmix signal (e.g. of the speaker of a multi-channel rendering system). By way of example, the first set of metadata may comprise one or more data elements which describe a property of a downmix signal (which has been derived from at least one of the plurality of audio objects using a downmix unit). Furthermore, the second set of metadata may comprise one or more data elements which describe a property of one or more of the plurality of audio objects (notably of one or more audio objects which have been the basis for determining the downmix signal).

The method comprises identifying a redundant data element which is common to (i.e. which is identical within) the first and second sets of metadata. In particular, a data element from the first set of metadata may be identified which comprises the same information (e.g. the same positional information, the same width information and/or the same gain/strength information) as a data element from the second set of metadata. Such a redundant data element may be due to the fact that a downmix signal (that the first set of metadata is associated with) has been derived from one or more audio objects (that the second set of metadata is associated with).

The method further comprises encoding the redundant data element of the first set of metadata by referring to a redundant data element of a set of metadata which is external to the first set of metadata, e.g. of the second set of metadata. In other words, instead of transmitting the redundant data element twice (within the first and within the second set of metadata), the redundant data element is only transmitted once (e.g. within the second set of metadata) and identified within the first set of metadata by a reference to a set of metadata other than the first set of metadata (e.g. to the second set of metadata). By doing this, the data rate which is required for the transmission of the metadata of the plurality of audio objects may be reduced.

As such, the redundant data element of the first set of metadata may be encoded by referring to the redundant data element of the second set of metadata. Alternatively, the redundant data element of the first set of metadata may be encoded by referring to the redundant data element of a dedicated set of metadata comprising some or all of the redundant data elements of a bitstream. The dedicated set of metadata may be separate from the second set of metadata. Hence, also the redundant data element of the second set of metadata may be encoded by referring to the redundant data element of the dedicated set of metadata, thereby ensuring that the redundant data element is only transmitted once within the bitstream.

Encoding may comprise adding a flag to the first set of metadata. The flag (e.g. a one bit value) may indicate whether the redundant data element is explicitly comprised within the first set of metadata or whether the redundant data element is only comprised within the second set of metadata or within a dedicated set of metadata. Hence, the redundant data element may be replaced by a flag within the first set of metadata, thereby further reducing the data rate which is required for the transmission of the metadata.

The first and second sets of metadata may comprise one or more data structures which are indicative of a property of an audio object from the plurality of audio objects and/or of the downmix signal. A data structure may comprise a plurality of data elements. As such, the data elements may be organized in a hierarchical manner. The data structures may regroup and represent a plurality of data elements at a higher level. The method may comprise identifying a redundant data structure which comprises at least one redundant data element which is common to the first and second sets of metadata. For a fully redundant data structure all data elements may be common to (or identical for) the first and second sets of metadata.

The method may further comprise encoding the redundant data structure of the first set of metadata by referring at least partially to the redundant data structure of the second set of metadata or to a redundant data structure of a dedicated set of metadata, i.e. to a redundant data structure which is external to the first set of metadata. Encoding the redundant data structure may comprise encoding the at least one redundant data element of the redundant data structure of the first set of metadata by reference to a set of metadata which is external to the first set of metadata (e.g. to the second set of metadata). Furthermore, one or more data elements of the redundant data structure of the first set of metadata, which are not common to (or not identical for) the first and second sets of metadata, may be explicitly included into the first set of metadata. As such, a data structure may be differentially encoded within the first set of metadata, such that only the differences with regards to the corresponding data structure of the second set of metadata are included into the first set of metadata. The identical (i.e. redundant) data elements may be encoded by providing a reference to the second set of metadata (e.g. using a flag).

Encoding the redundant data structure may comprise adding a flag to the first set of metadata, which indicates whether the redundant data structure is at least partially removed from the first set of metadata. In other words, the flag (e.g. a one bit value) may indicate whether at least one or more of the data elements are encoded by reference to one or more identical data elements of a set of metadata which is external to the first set of metadata (e.g. to the second set of metadata).

As already indicated above, a property of an audio object or of a downmix signal may describe how the audio object or the downmix signal is to be rendered by an object-based or by a channel-based renderer. In other words, a property of an audio object or of a downmix signal may comprise one or more instructions to or information for an object-based or channel-based renderer indicative of how the audio object or the downmix signal is to be rendered.

In particular, a data element which describes a property of an audio object or of a downmix signal may comprise one or more of: gain information which is indicative of one or more gains to be applied to the audio object or the downmix signal by the renderer (e.g. gain information for the source or the speaker); positional information which is indicative of one or more positions of the audio object or the downmix signal (i.e. of the source of an audio signal or of the speaker which renders the audio signal) in the three dimensional space; width information which is indicative of a spatial extent of the audio object or the downmix signal (i.e. of the source of an audio signal or of the speaker which renders the audio signal) within the three dimensional space; ramp duration information which is indicative of a modification speed of a property of the audio object or the downmix signal; and/or temporal information (e.g. a timestamp) which is indicative of when the audio object or the downmix signal exhibit a property.

The second set of metadata (e.g. the object audio metadata) may comprise one or more data elements for each of the plurality of audio objects. Furthermore, the second set of metadata may be indicative of one or more properties of each of the plurality of audio objects (e.g. some or all of the above mentioned properties).

The first set of metadata (e.g. the side information and/or the additional downmix metadata) may be associated with the downmix signal, wherein the downmix signal may have been generated by downmixing N audio objects into M downmix signals (M being smaller than N) using a downmix unit of an audio encoder. In particular, the first set of metadata may comprise information for upmixing the M downmix signals to generate N reconstructed audio objects. Furthermore, the first set of metadata may be indicative of a property of each of the M downmix signals (which may be used by a renderer to render the M downmix signals, e.g. to determine positions for the M speakers which render the M downmix signals, respectively). As such, the first set of metadata may comprise the side information which has been generated by an (adaptive) downmix unit. Alternatively or in addition, the first set of metadata may comprise information for converting the M downmix signals into M backward-compatible downmix signals which are associated with respective M channels (e.g. 5.1 or 7.1 channels) of a legacy multi-channel renderer (e.g. a 5.1 or a 7.1 rendering system). As such, the second set of metadata may comprise the additional downmix metadata which has been generated by an adaptive downmix unit.

According to another aspect, an encoding system configured to generate a bitstream indicative of a plurality of audio objects of an audio scene (e.g. for rendering by an object-based rendering system) is described. The bitstream may be further indicative of one or more (e.g. M) downmix signals (e.g. for rendering by a channel-based rendering system).

The encoding system may comprise a downmix unit which is configured to generate at least one downmix signal from the plurality of audio objects. In particular, the downmix unit may be configured to generate a downmix signal from the plurality of audio objects by clustering one or more audio objects (e.g. using a scene simplification module).

The encoding system may further comprise an analysis unit (also referred to herein as a cluster analysis unit) which is configured to generate downmix metadata associated with the downmix signal. The downmix metadata may comprise the side information and/or the additional downmix metadata described in the present document.

The encoding system comprises an encoding unit (also referred to herein as the encoding and multiplexing unit) which is configured to generate the bitstream comprising a first set of metadata and a second set of metadata. The sets of metadata may be generated such that at least one of the first and second sets of metadata is associated with (or comprises) the downmix metadata. Furthermore, the sets of metadata may be generated such that the first and second sets of metadata comprise one or more data elements which are indicative of a property of an audio object from the plurality of audio objects and/or of the downmix signal. In addition, the sets of metadata may be generated such that a redundant data element of the first set of metadata, which is common to (or identical for) the first and second sets of metadata, is encoded by reference to a redundant data element of a set of metadata which is external to the first set of metadata (e.g. of the second set of metadata).

According to a further aspect, a method for decoding a bitstream indicative of a plurality of audio objects of an audio scene (and/or indicative of a downmix signal) is described. The bitstream comprises a first set of metadata and a second set of metadata. At least one of the first and second sets of metadata may be associated with a downmix signal derived from the plurality of audio objects. The first and second sets of metadata comprise one or more data elements which are indicative of a property of an audio object from the plurality of audio objects and/or of the downmix signal.

The method comprises detecting that a redundant data element of the first set of metadata is encoded by referring to a redundant data element of the second set of metadata. Furthermore, the method comprises deriving the redundant data element of the first set of metadata from a redundant data element of a set of metadata which is external to the first set of metadata (e.g. of the second set of metadata).

According to another aspect a decoding system configured to receive a bitstream indicative of a plurality of audio objects of an audio scene is described. The bitstream comprises a first set of metadata and a second set of metadata. At least one of the first and second sets of metadata may be associated with a downmix signal derived from the plurality of audio objects. The first and second sets of metadata comprise one or more data elements which are indicative of a property of an audio object from the plurality of audio objects and/or of the downmix signal.

The decoding system is configured to detect that a redundant data element of the first set of metadata is encoded by reference to a redundant data element of the second set of metadata. Furthermore, the decoding system is configured to derive the redundant data element of the first set of metadata from a redundant data element of a set of metadata which is external to the first set of metadata (e.g. of the second set of metadata).

According to a further aspect, a bitstream indicative of a plurality of audio objects of an audio scene is described. The bitstream may be further indicative of one or more downmix signals derived from one or more of the plurality of audio objects. The bitstream comprises a first set of metadata and a second set of metadata. At least one of the first and second sets of metadata may be associated with a downmix signal derived from the plurality of audio objects. The first and second sets of metadata comprise one or more data elements which are indicative of a property of an audio object from the plurality of audio objects and/or of the downmix signal. Furthermore, a redundant data element of the first set of metadata is encoded by reference to a set of metadata which is external to the first set of metadata (e.g. the second set of metadata).

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

SHORT DESCRIPTION OF THE FIGURES

The invention is explained below in an exemplary manner with reference to the accompanying drawings, wherein FIG. 1 shows a block diagram of an example audio encoding/decoding system;

DETAILED DESCRIPTION

Figure 1:
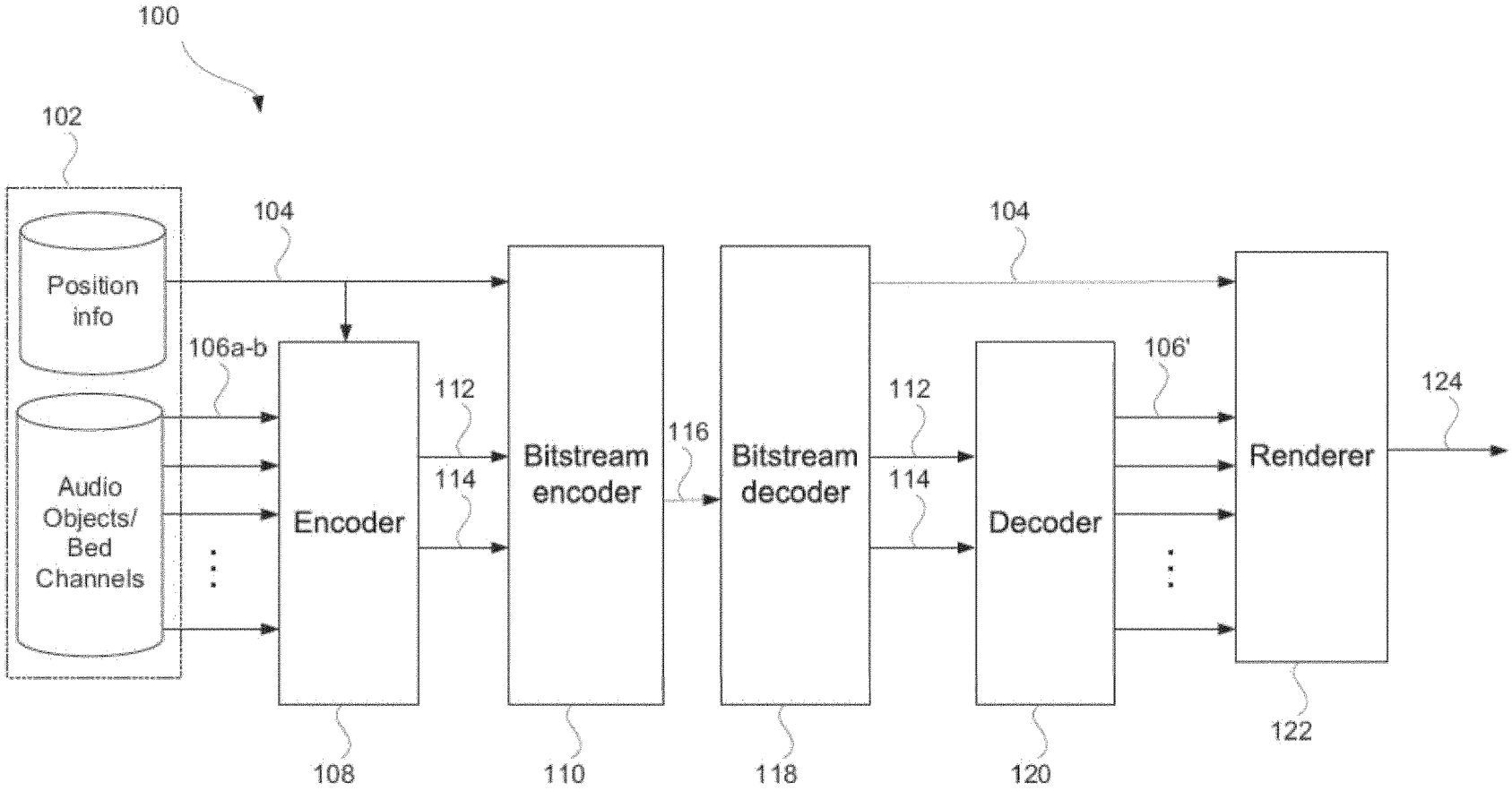

FIG. 1 illustrates an example immersive audio encoding/decoding system 100 for encoding/decoding of an audio scene 102. The encoding/decoding system 100 comprises an encoder 108, a bitstream generating component 110, a bitstream decoding component 118, a decoder 120, and a renderer 122.

The audio scene 102 is represented by one or more audio objects 106*a*, i.e. audio signals, such as N audio objects. The audio scene 102 may further comprise one or more bed channels 106*b*, i.e. signals that directly correspond to one of the output channels of the renderer 122. The audio scene 102 is further represented by metadata comprising positional information 104. This metadata is referred to as object audio metadata or OAMD 104. The object audio metadata 104 is for example used by the renderer 122 when rendering the audio scene 102. The object audio metadata 104 may associate the audio objects 106*a*, and possibly also the bed channels 106*b*, with a spatial position in a three dimensional (3D) space as a function of time. The object audio metadata 104 may further comprise other types of data which is useful in order to render the audio scene 102.

The encoding part of the system 100 comprises the encoder 108 and the bitstream generating component 110. The encoder 108 receives the audio objects 106*a*, the bed channels 106*b* if present, and the object audio metadata 104. Based thereupon, the encoder 108 generates one or more downmix signals 112, such as M downmix signals (e.g. M<N). By way of example, the downmix signals 112 may correspond to the channels [Lf Rf Cf Ls Rs LFE] of a 5.1 audio system. ("L" stands for left, "R" stands for right, "C" stands for center, "f" stands for front, "s" stands for surround and "LFE" for low frequency effects). Alternatively, an adaptive downmix may be performed as outlined below.

The encoder 108 further generates side information 114 (also referred to herein as sideinfo). The side information 114 typically comprises a reconstruction matrix. The reconstruction matrix comprises matrix elements that enable reconstruction of at least the audio objects 106*a* (or an approximation thereof) from the downmix signals 112. The reconstruction matrix may further enable reconstruction of the bed channels 106*b*. Furthermore, the side information 114 may comprise positional information regarding the spatial position in a three dimensional (3D) space as a function of time of one or more of the downmix signals 112.

The encoder 108 transmits the M downmix signals 112, and the side information 114 to the bitstream generating component 110. The bitstream generating component 110 generates a bitstream 116 comprising the M downmix signals 112 and at least some of the side information 114 by performing quantization and encoding. The bitstream generating component 110 further receives the object audio metadata 104 for inclusion in the bitstream 116.

The decoding part of the system comprises the bitstream decoding component 118 and the decoder 120. The bitstream decoding component 118 receives the bitstream 116 and performs decoding and dequantization in order to extract the M downmix signals 112 and the side information 114 comprising e.g. at least some of the matrix elements of the reconstruction matrix. The M downmix signals 112 and the side information 114 are then input to the decoder 120 which based thereupon generates a reconstruction 106' of the N audio objects 106*a* and possibly also the bed channels 106*b*. The reconstruction 106' of the N audio objects is hence an approximation of the N audio objects 106*a* and possibly also of the bed channels 106*b*.

By way of example, if the downmix signals 112 correspond to the channels [Lf Rf Cf Ls Rs LFE] of a 5.1 configuration, the decoder 120 may reconstruct the objects 106' using only the full-band channels [Lf Rf Cf Ls Rs], thus ignoring the LFE. This also applies to other channel configurations. The LFE channel of the downmix 112 may be sent (basically unmodified) to the renderer 122.

The reconstructed audio objects 106', together with the object audio metadata 104, are then input to the renderer 122. Based on the reconstructed audio objects 106' and the object audio metadata 104, the renderer 122 renders an output signal 124 having a format which is suitable for playback on a desired loudspeaker or headphones configuration. Typical output formats are a standard 5.1 surround setup (3 front loudspeakers, 2 surround loud speakers, and 1 low frequency effects, LFE, loudspeaker) or a 7.1+4 setup (3 front loudspeakers, 4 surround loud speakers, 1 LFE loudspeaker, and 4 elevated speakers).

In some embodiments, the original audio scene may comprise a large number of audio objects. Processing of a large number of audio objects comes at the cost of relatively high computational complexity. Also the amount of metadata (the object audio metadata 104 and the side information 114) to be embedded in the bitstream 116 depends on the number of audio objects. Typically the amount of metadata grows linearly with the number of audio objects. Thus, in order to save computational complexity and/or to reduce the data rate needed to encode the audio scene 102, it may be advantageous to reduce the number of audio objects prior to encoding. For this purpose the audio encoder/decoder system 100 may further comprise a scene simplification module (not shown) arranged upstream of the encoder 108. The scene simplification module takes the original audio objects and possibly also the bed channels as input and performs processing in order to output the audio objects 106*a*. The scene simplification module reduces the number, K say, of original audio objects to a more feasible number N of audio objects 106*a* by performing clustering (K>N). More precisely, the scene simplification module organizes the K original audio objects and possibly also the bed channels into N clusters. Typically, the clusters are defined based on spatial proximity in the audio scene of the K original audio objects/bed channels. In order to determine the spatial proximity, the scene simplification module may take object audio metadata 104 of the original audio objects/bed channels as input. When the scene simplification module has formed the N clusters, it proceeds to represent each cluster by one audio object. For example, an audio object representing a cluster may be formed as a sum of the audio objects/bed channels forming part of the cluster. More specifically, the audio content of the audio objects/bed channels may be added to generate the audio content of the representative audio object. Further, the positions of the audio objects/bed channels in the cluster may be averaged to give a position of the representative audio object. The scene simplification module includes the positions of the representative audio objects in the object audio metadata 104. Further, the scene simplification module outputs the representative audio objects which constitute the N audio objects 106*a* of FIG. 1.

The M downmix signals 112 may be arranged in a first field of the bitstream 116 using a first format. The side information 114 may be arranged in a second field of the bitstream 116 using a second format. In this way, a decoder that only supports the first format is able to decode and playback the M downmix signals 112 in the first field and to discard the side information 114 in the second field. The audio encoder/decoder system 100 of FIG. 1 may support both the first and the second format. More precisely, the decoder 120 may be configured to interpret the first and the second formats, meaning that it may be capable of reconstructing the objects 106' based on the M downmix signals 112 and the side information 114.

As such, the system 100 for the encoding of objects/clusters may make use of a backward-compatible downmix (for example with a 5.1 configuration) that is suitable for direct playback on legacy decoding system 120 (as outlined above). Alternatively or in addition, the system may make use of an adaptive downmix that is not required to be backward-compatible. Such an adaptive downmix may further be combined with optional additional channels (which are referred to herein as "L auxiliary signals"). The resulting encoder and decoder of such a coding system 200 using an adaptive downmix with M channels (and, optionally, L additional channels) is shown in FIG. 2.

Figure 2:
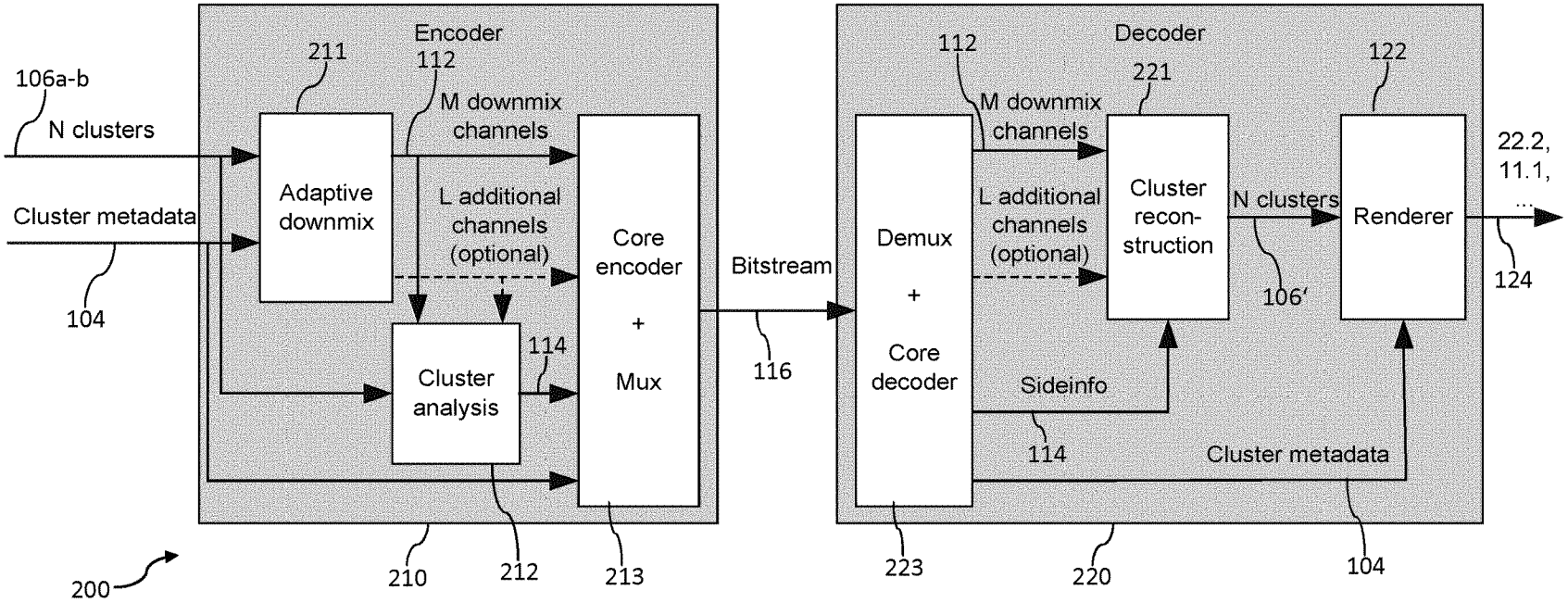
FIG. 2 shows further details of an example audio encoding/decoding system.

FIG. 2 shows details regarding an encoder 210 and a decoder 220. The components of the encoder 210 may correspond to the components 108, 110 of the system 100 of FIG. 1 and the components of the decoder 220 may correspond to the components 118, 120 of the system 100 of FIG. 1. The encoder 210 comprises a downmix unit 211 configured to generate the downmix signals 112 using the audio objects (or clusters) 106*a* and the object audio metadata 104. Furthermore, the encoder 210 comprises a cluster/object analysis unit 212 which is configured to generate the side information 114 based on the downmix signals 112, the audio objects 106*a* and the object audio metadata 104. The downmix signals 112, the side information 114 and the object audio metadata 114 may be encoded and multiplexed within the encoding and multiplexing unit 213, to generate the bitstream 116.

The decoder 220 comprises a demultiplexing and decoding unit 223 which is configured to derive the downmix signals 112, the side information 114 and the object audio metadata 104 from the bitstream 116. Furthermore, the decoder 220 comprises a cluster reconstruction unit 221 configured to generate a reconstruction 106' of the audio objects 106*a* based on the downmix signals 112 and based on the side information 114. Furthermore, the decoder 220 may comprise a renderer 122 for rendering the reconstructed audio objects 106' using the object audio metadata 104.

Because the cluster/object analysis unit 212 of the encoder 210 receives the N audio objects 106*a* and the M downmix signals 112 as input, the cluster/object analysis unit 212 may be used in conjunction with an adaptive downmix (instead of a backward-compatible downmix). The same holds true for the cluster/object reconstruction 221 of the decoder 220.

The advantage of an adaptive downmix (compared to a backward-compatible downmix) can be shown by considering content that comprises two clusters/objects 106*a* that would be mixed into the same downmix channel of a backward-compatible downmix. An example for such content comprises two clusters/objects 106*a* that have the same horizontal position of the left front speaker but a different vertical position. If such content is rendered to e.g. a 5.1 backward-compatible downmix (which comprises 5 channels in the same vertical position, i.e., located on a horizontal plane), both clusters/objects 106*a* would end up in the same downmix signal 112, e.g. for the left front channel. This constitutes a challenging situation for the cluster reconstruction 221 in the decoder 220, which would have to reconstruct approximations 106' of the two clusters/objects 106*a* from the same single downmix signal 112. In such a case, the reconstruction process may lead to imperfect reconstruction and/or to audible artifacts. An adaptive downmix system 211, on the other hand, could for example place the first cluster/object 106*a* into a first adaptive downmix signal 112 and the second cluster/object 106*a* into a second adaptive downmix signal 112. This enables perfect reconstruction of the clusters/objects 106*a* at the decoder 220. In general, such perfect reconstruction is possible as long as the number N of active clusters/objects 106*a* does not exceed the number M of downmix signals 112. If the number N of active clusters/objects 106*a* is higher, then an adaptive downmix system 211 may be configured to select the clusters/objects 106*a* that are to be mixed into the same downmix signal 112 such that the possible approximation errors occurring in the reconstructed clusters/objects 106' at the decoder 220 have no or the smallest possible perceptual impact on the reconstructed audio scene.

A second advantage of the adaptive downmix is the ability to keep certain objects or clusters 106*a* strictly separate from other objects or clusters 106*a*. For example, it can be advantageous to keep any dialog object 106*a* separate from background objects 106*a*, to ensure that dialog is (1) rendered accurately in terms of spatial attributes, and (2) allows for object processing at the decoder 220, such as dialog enhancement or increase of dialog loudness for improved intelligibility. In other applications (e.g. Karaoke), it may be advantageous to allow complete muting of one or more objects 106*a*, which also requires that such objects 106*a* are not mixed with other objects 106*a*. Methods using a backward-compatible downmix do not allow for complete muting of objects 106*a* which are present in a mix of other objects.

An advantageous approach to automatically generate an adaptive downmix makes use of concepts that may also be employed within a scene simplification module (which generates a reduced number N of clusters 106*a* from a higher number K of audio objects). In particular, a second instance of a scene simplification module may be used. The N clusters 106*a* together with their associated object audio metadata 104 may be provided as the input into (the second instance of) the scene simplification module. The scene simplification module may then generate a smaller set of M clusters at an output. The M clusters may then be used as the M channels 112 of the adaptive downmix 211. The scene simplification module may be comprised within the downmix unit 211.

When using an adaptive downmix 211 the resulting downmix signals 112 may be associated with side information 114 which allows for a separation of the downmix signals 112, i.e. which allows for an upmix of the downmix signals 112 to generate the N reconstructed clusters/objects 106 '. Furthermore, the side information 114 may comprise information which allows the different downmix signals 112 to be placed in a three dimensional (3D) space as a function of time. In other words, the downmix signals 112 may be associated with one or more speakers of a rendering system 122, wherein the position of the one or more speakers may vary in space as a function of time (in contrast to backward-compatible downmix signals 112 which are typically associated with respective speakers that have a fixed position in space).

Systems which are using a backward-compatible downmix (e.g. a 5.1 downmix) enabled low complexity decoding for legacy playback systems (e.g. for a 5.1 multi-channel loudspeaker setup) by decoding the backward-compatible downmix signals 112, and by discarding other parts of the bitstream 116 such as the side information 114 and the object audio metadata 104 (also referred to herein as cluster metadata). However, if an adaptive downmix is used, such a downmix is typically not suitable for direct playback on a legacy multi-channel rendering system 122.

An approach to enable low complexity decoding for legacy playback systems when using an adaptive downmix is to derive additional downmix metadata and to include this additional downmix metadata in the bitstream 116 which is conveyed to the decoder 220. The decoder 220 may then use the additional downmix metadata in combination with the adaptive downmix signals 112 to render the downmix signals 112 using a legacy playback format (e.g. a 5.1 format).

Figure 3:
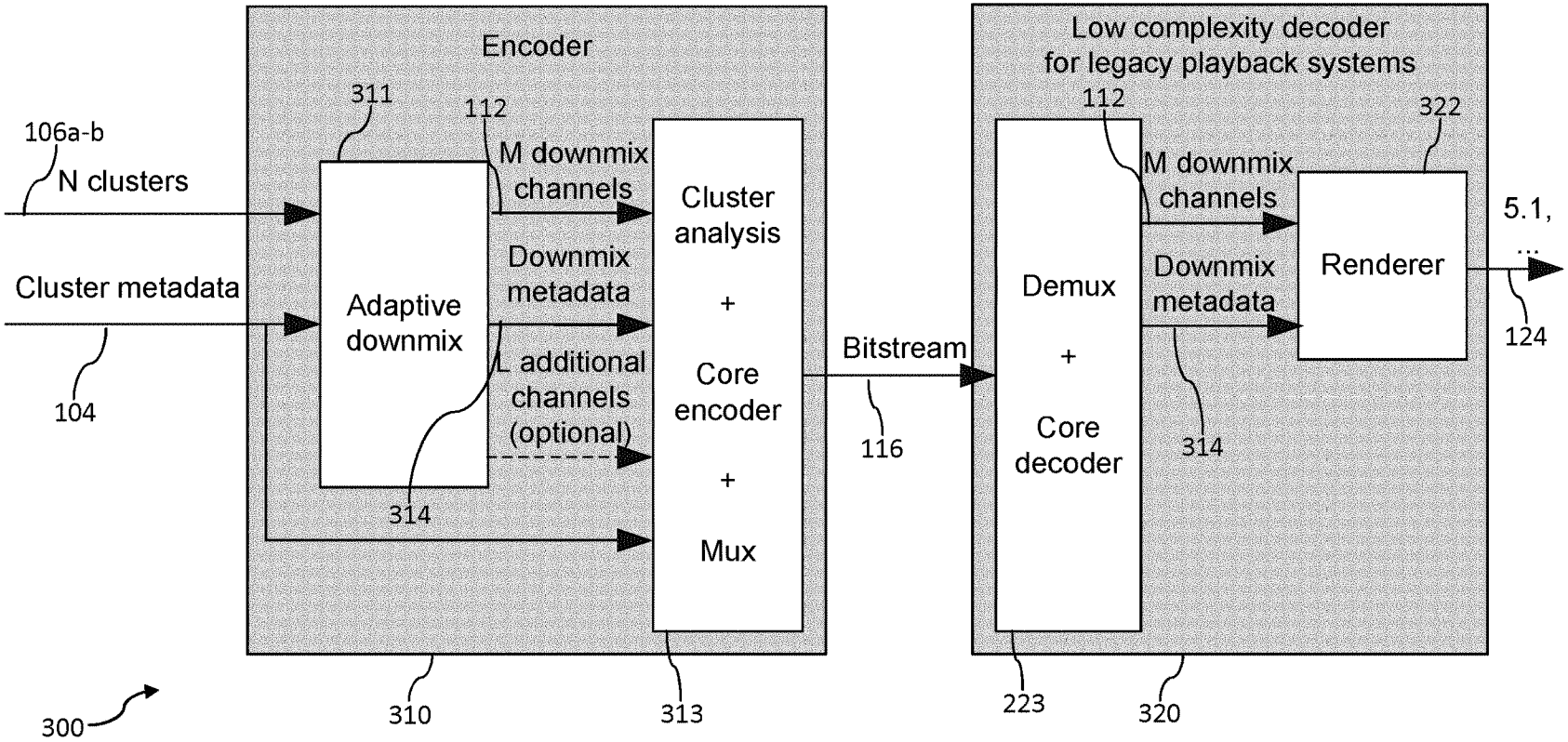
FIG. 3 shows excerpts of an example audio encoding/decoding system which is configured to perform an adaptive downmix.
Figure 4:
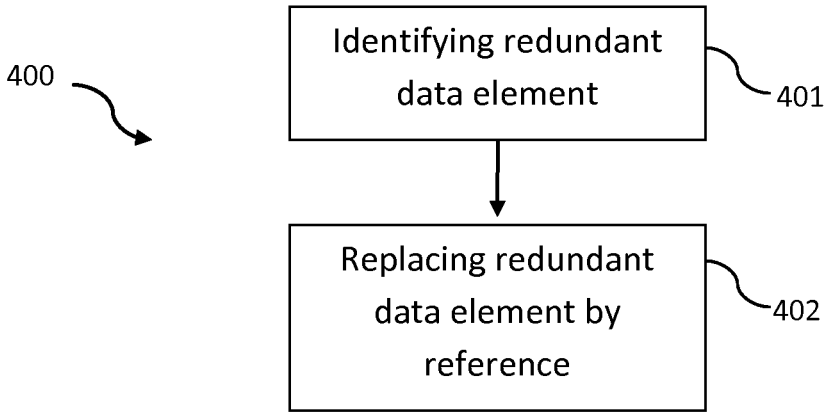
FIG. 4 shows a flow chart of an example method for reducing the data rate of a bitstream comprising a plurality of sets of metadata.

FIG. 3 shows a system 300 comprising an encoder 310 and a decoder 320. The encoder 310 is configured to generate and the decoder 320 is configured to process additional downmix metadata 314 (also referred to herein as SimpleRendererinfo) which enables the decoder 320 to generate backward-compatible downmix channels from the adaptive downmix signals 112. This may be achieved by a renderer 322 having a relatively low computational complexity. Other parts of the bitstream 116, like e.g. optional additional channels, side information 114 for parameterized upmix, and object audio metadata 104 may be discarded by such a low complexity decoder 320. The downmix unit 311 of the encoder 310 may be configured to generate the additional downmix metadata 314 based on the downmix signals 112, based on the side information 114 (not shown in FIG. 3), based on the N clusters 106*a* and/or based on the object audio metadata 104.

As described above, an advantageous way to generate the adaptive downmix and the associated downmix metadata (i.e. the associated side information 114) is to use a scene simplification module. In this case, the additional downmix metadata 314 typically comprises metadata for the (adaptive) downmix signals 112, which is indicative of the spatial positions of the downmix signals 112 as a function of time. This means that the same renderer 122 as shown in FIG. 2 may be used within the low complexity decoder 320 of FIG. 3, with the only difference that the renderer 322 now takes (adaptive) downmix signals 112 and their associated additional downmix metadata 314 as input, instead of reconstructed clusters 106' and their associated object audio metadata 104.

In the context of FIGS. 1, 2 and 3 three different types or sets of metadata, notably object audio metadata 104, side information 114 and additional downmix metadata 314, have been described. A further type or set of metadata may be directed at the personalization of an audio scene 102. In particular, personalized object audio metadata may be provided within the bitstream 116 to allow for an alternative rendering of some or all of the objects 106*a*. An example for such a personalized object audio metadata may be that, during a soccer game, the user can chose between object audio metadata which is directed at a "home crowd", at an "away crowd" or at a "neutral mix". The "neutral mix" metadata could provide a listener with the experience of being placed in a neutral (e.g. central) position of a soccer stadium, wherein the "home crowd" metadata could provide the listener with the experience of being placed near the supporters of the home team, and the "away crowd" metadata could provide the listener with the experience of being placed near the supporters of the guest team. Hence, a plurality of different sets 104 of object audio metadata may be provided with the bitstream 116. Furthermore, different sets 104 of side information and/or sets 314 of additional downmix metadata may be provided for the plurality of different sets 104 of object audio metadata. Hence, a large number of sets of metadata may be provided within the bitstream 116.

As indicated above, the present document addresses the technical problem of reducing the data rate which is required for transmitting the various different types or sets of metadata, notably the object audio metadata 104, the side information 114 and the additional downmix metadata 314.

It has been observed that the different types or sets 104, 114, 314 of metadata comprise redundancies. In particular, it has been observed that at least some of the different types or sets 104, 114, 314 of metadata may comprise identical data elements or data structures. These data elements/data structures may relate to timestamps, gain values, object position and/or ramp durations. In more general terms, some or all of the different types or sets 104, 114, 314 of metadata may comprise the same data elements/data structures which describe a property of an audio object.

In the present document, a method 400 for identifying and/or removing redundancies within the different metadata types 104, 114, 314 is described. The method 400 comprises the step of identifying 401 a data element/data structure which is comprised in at least two sets 104, 114, 314 of metadata of an encoded audio scene 102 (e.g. of a temporal frame of the audio scene 102). Instead of transmitting the identical data element/data structure several times within the different sets 104, 114, 314 of metadata, the data element/data structure of a first set 114, 314 of metadata may be replaced 402 by a reference to the identical data element within a second set 104 of metadata. This may be achieved e.g. using a flag (e.g. a one bit value) which indicates whether a data element is explicitly provided within the first set 114, 314 of metadata or whether the data element is provided by reference to the second set 104 of metadata. As such, the method 400 reduces the data rate of bitstream 116 and makes the bitstream 116 which comprises two or three different sets/types 104, 114, 314 of metadata (e.g. the metadata OAMD, sideinfo, and/or SimpleRendererinfo) substantially more efficient. A flag, e.g. one bit, may be used to signal within the bitstream 116 whether the redundant information (i.e. the redundant data element) is stored within the first set 114, 314 of metadata or is referenced with respect to the second set 104 of metadata. The use of such a flag provides increased coding flexibility.

Furthermore, differential coding may be used to further reduce the data rate for encoding metadata. If the information is referenced externally, i.e. if a data element/data structure of the first set 114, 314 of metadata is encoded by providing a reference to the second set 104 of metadata, differential coding of a data element/data structure may be used instead of using direct coding. Such differential coding may notably be used for encoding data elements or data fields relating to object positions, object gains and/or object width.

Tables 1a to 1f illustrate excerpts of an example syntax for object audio metadata (OAMD) 104. An "oamd_substream( )" comprises the spatial data for one or more audio objects 106*a*. The number N of audio objects 106*a* corresponds to the parameter "n_obs". Functions which are printed in bold are described in further detail within the AC4 standard. The numbers at the right side of a Table indicate a number of bits used for a data element or data structure. In the following tables, the parameters which are shown in conjunction with a number of bits may be referred to as "data elements". Structures which comprise one or more data elements or other structures may be referred to as "data structures". Data structures are identified by the brackets "( )" following a name of the data structure.

Parameters or data elements or data structures, which are printed in italic and which are underlined, refer to parameters or data elements or data structures, which may be used for exploiting redundancy. As indicated above, the parameters or data elements or data structures, which may be used for exploiting metadata redundancy may relate to

- Timestamps: oa_sample_offset_code, oa_sample_offset;
- Ramp durations: block_offset_factor, use_ramp_table, ramp_duration_table, ramp_duration;
- Object gain: object_gain_code, object_gain_value;
- Object positions: diff_pos3D_X, diff_pos3D_Y, diff_pos3D_Z, pos3D_X, pos3D_Y, pos3D_Z, pos3D_Z_sign;
- Object width: object_width, object_width_X, object_width_Y, object_width_Z;

TABLE 1a

| Syntax | No. of bits |
|---|---|
| oamd_substream(n_objs, b_iframe_oamd, b_alterantive, obj_type[n_objs], b_joc_coded[n_objs]) | |
| { | |
| if (**b_oamd**_common_**data_present**) { | **1** |
| oamd_common_data( ) | |
| } | |
| if (**b_oamd_timing_present**) { | 1 |
| oamd_timing_data( ) | |
| } | |
| if (b_alternative == 0) { | |
| if (**b_oamd_dyn_data_present**) { | 1 |
| oamd_dyndata_multi(n_objs, n_blocks, b_iframe_oamd, obj_type[n_objs], b_joc_coded[n_objs]) | |
| } | |
| } | |
| **byte_align;** | **0 . . . 7** |
| } | |

TABLE 1b

| Syntax | No. of bits |
|---|---|
| oamd_timing_data( ) | |
| { | |
| oa_sample_offset_type( ) | |
| if (oa_sample_offset_type == 0b10) { | |
| oa_sample_offset_code( ); | |
| } else if (oa_sample_offset_type == 0b11) { | |
| **oa_sample_offset;** | 5 |
| } | |
| **num_objInfo_blocks;** | 3 |
| for (blk = 0; blk < num_objInfo_blocks; blk++) { | |
| **block_offset_factor;** | 6 |
| **ramp_duration_code;** | 2 |
| if (ramp_duration_code = 0b11) { | |
| if (b_**use_ramp_table**) { | 1 |
| **ramp_duration_table;** | 4 |
| } else { | |
| **ramp_duration;** | 11 |
| } | |
| } | |
| } | |
| } | |

TABLE 1c

| Syntax | No. of bits |
|---|---|
| oamd_dyndata_single(n_objs, n_blocks, b_iframe_oamd, b_alterantive, obj_type[n_objs]) | |
| { | |
| for (i=0; i<n_objs, i++) { | |
| if (obj_type[i] == DYN) { | |
| b_dyn_object = 1; | |
| } else | |
| b_dyn_object = 0; | |
| } | |
| for (b=0; b<n_blocks_b++) { | |
| object_info_block(b_iframe_oamd && (b==0), b_dyn_object) | |
| } | |
| } | |

TABLE 1d

| Syntax | No. of bits |
|---|---|
| object_info_block(b_no_delta, b_dynamic_object) | |
| { | |
| if (**b_object_not_active**) { | **1** |
| object_basic_info_status = 0 //DEFAULT | |
| } else { | |
| if (b_no_delta) { | |
| object_basic_info_status = 1 //ALL NEW | |
| } else { | |
| if (**b_basic_info_reuse**) { | **1** |
| object_basic_info_status = 2 //REUSE | |
| } else | |
| object_basic_info_status = 1 //ALL NEW | |
| } | |
| } | |
| } | |
| if ((object_basic_info_status == 1) //ALL NEW { | |
| object_basic_info( ) | |
| } | |
| if (b_object_not_active) { | |
| object_render_info_status = 0 //DEFAULT | |
| } else { | |
| if (b_dynamic_object( )) { | |
| if (b_no_delta) { | |
| object_render_info_status = 1 //ALL_NEW | |
| } else { | |
| if(**b_render_info_reuse**) { | **1** |
| object_render_info_status = 2 //REUSE | |
| } else { | |
| if(**b_render_info_partial_reuse**) { | **1** |
| object_render_info_status = 3 //PART_REUSE | |
| } else { | |
| object_render_info_status = 1 //ALL_NEW | |
| } | |
| } | |
| } | |
| } else { | |
| object_render_info_status = 0 //DEFAULT | |
| } | |
| } | |
| if ((object_render_info_status == 1) \|\| (object_render_info_status == 3)) { | |
| object_render_info( ) | |
| } | |
| if (**b_add_table_data**) { | **1** |
| **add_table_data_size_minus1;** | **4** |
| atd_size = add_table_data_size_minus1 + 1; | |
| **add_table_data;** | **8 * atd_size** |
| } | |
| } | |

TABLE 1e

| Syntax | No. of bits |
|---|---|
| object_basic_info ( ) | |
| { | |
| if (!**default_basic_info_md**) { | **1** |
| **basic_info_md** | **1/2** |
| if (basic_info_md ==0b \|\| basic_info_md==10b) { | |
| **obj_gain_code** | **1/2** |
| if (obj_gain_code==10b) { | |
| **object_gain_value** | **6** |
| } | |
| } | |
| if (basic_info_md ==10b \|\| basic_info_md==11b) { | |
| **object_priority** | **5** |
| } | |
| } | |
| } | |

TABLE 1f

| Syntax | No. of bits |
|---|---|
| object_render_info (object_render_info_status, b_no_delta) | |
| { | |
| if (object_render_info_status = 1) { //all new values | |
| obj_render_info_mask = 111b // position, zone, grouped MD | |
| } else { // indicate those that have changed | |
| **obj_render_info_mask** | **3** |
| } | |
| if (obj_render_info_mask & 001b) { | |
| if (b_no_delta) { | |
| b_diff_pos_coding = false | |
| } else { | |
| **b_diff_pos_coding** | **1** |
| } | |
| if (b_diff_pos_coding) { | |
| **diff_pos3D_X** | **3** |
| **diff_pos3D_Y** | **3** |
| **diff_pos3D_Z** | **3** |
| } else { | |
| **pos3D_X** | **6** |
| **pos3D_Y** | **6** |
| **pos3D_Z_sign** | **1** |
| **pos3D_Z** | **4** |
| } | |
| } | |

TABLE 1f-continued

| Syntax | No. of bits |
|---|---|
| if (obj_render_info_mask & 010b) { | |
| if (!**b_grouped_zone_defaults**) { | **1** |
| **group_zone_mask** | **3** |
| if (group_zone_mask & 001b) { | |
| **zone_mask** | **3** |
| } | |
| if (group_zone_mask & 010b) { | |
| b_enable_elevation = 0 | |
| } | |
| if (group_zone_mask & 100b) { | |
| b_object_snap = 1 | |
| } | |
| } | |
| } | |
| if (obj_render_info_mask & 100b) { | |
| if (!**b_grouped_other_defaults**) { | **1** |
| **group_other_mask** | **3** |
| if (group_other_mask & 001b) { | |
| if (b_**object_width_mode**==0) { | **1** |
| **object_width** | **5** |
| } else { | |
| **object_width_X** | **5** |
| **object_width_Y** | **5** |
| **object_width_Z** | **5** |
| } | |
| } | |
| if (group_other_mask & 010b) { | |
| **object_screen_factor** | **3** |
| **object_depth_factor** | **2** |
| } else{ | |
| object_screen_factor =0 | |
| } | |
| if (group_other_mask & 100b) { | |
| if (**b_obj_at_infinity**) { | **1** |
| obj_distance = inf | |
| } else { | |
| **obj_distance_factor** | **4** |
| } | |
| } | |
| } | |
| } | |
| } | |

Table 2 illustrates excerpts of an example syntax for side information 114 (notably when using adaptive downmixing). It can be seen that the side information 114 may comprise the data element or data structure "oamd_timing_data( )" (or at least a portion thereof) which is also comprised in the object audio metadata 104.

TABLE 2

| Syntax | No. of bits |
|---|---|
| audio_data_ajoc(n_upmix_signals, b_static_dmx, n_dmx_signals, b_lfe, b_iframe) | |
| { | |
| if (b_static_dmx) { | |
| audio_data_chan(b_lfe? 5.1 : 5.0, b_iframe) | |
| } else { //adaptive downmix | |
| dmx_active_signals_mask | ceil(log2(n_dmx_signals)) |
| var_channel_element(b_iframe, n_dmx_signals, b_lfe) | |
| if (**b_dmx_timing**) { | 1 |
| oamd_timing_data( ) | |
| } | |
| oamd_dyndata_single(n_dmx_signals, n_blocks, b_iframe_oamd, b_alternative, obj_type_dmx[n_dmx_signals]) | |

TABLE 2-continued

| Syntax | No. of bits |
|---|---|
| //for DMX | |
| **if (b_oamd_extension_present)** { | 1 |
| // trim and future OA element | |
| skip_bytes = **variable_bits(3)** +1 //in bytes | |
| **skip_bits** | **8 * skip_bytes** |
| } | |
| } //adaptive DMX | |
| ajoc(n_dmx_signals, n_upmix_signals) | |
| ajoc_dmx_de_data(n_dmx_signals, n_upmix_signals) | |
| if (**b_umx_timing**) { | |
| oamd_timing_data( ) | |
| } else | |
| **b_derive_timing_from_dmx** | 1 |
| } | |
| oamd_dyndata_single(n_umx_signals, n_blocks, b_iframe_oamd, b_alterantive, obj_type_umx[n_umx_signals] | |
| ( ) //for UM | |
| } | |

Tables 3a and 3b illustrate excerpts of an example syntax for additional downmix metadata 314 (when using adaptive downmixing). It can be seen that the additional downmix metadata 314 may comprise the data element or data structure "oamd_timing_data ( )" (or at least a portion thereof) which is also comprised in the object audio metadata 104. As such, timing data may be referenced.

TABLE 3a

| Syntax | No. of bits |
|---|---|
| audio_data_ajoc(n_upmix_signals, b_static_dmx, n_dmx_signals, b_lfe, b_iframe) | |
| { | |
| if (**b_dmx_timing**) { | 1 |
| oamd_timing_data( ) | |
| } | |
| oamd_dyndata_single(n_dmx_signals, n_blocks, b_iframe_oamd, b_alterantive, obj_type_dmx[n_dmx_signals]) | |
| //for DMX | |
| } | |

TABLE 3b

| Syntax | No. of bits |
|---|---|
| oamd_dyndata_single(n_objs, n_blocks, b_iframe, b_alternative, obj_type[n_objs], b_lfe[n_objs]) | |
| { | |
| for (i=0; i<n_objs, i++) { | |
| if (obj_type[i] == DYN and b_lfe[i] == 0) { | |
| b_dyn_object = 1; | |
| } else | |
| b_dyn_object = 0; | |
| } | |
| for (b=0; b<n_blocks_b++) { | |
| object_info_block((b_iframe !=0) && (b==0), b_dyn_object) | |
| } | |
| } | |
| } | |

The object audio metadata 104 may be used as a basic set 104 of metadata and the one or more other sets 114, 314 of metadata, i.e. the side information 114 and/or the additional downmix metadata 314, may be described with reference to one or more data elements and/or data structures of the basic set 104 of metadata. Alternatively or in addition, the redundant data elements and/or data structures may be separated from the object audio metadata 104. In this case, also the object audio metadata 104 may be described with reference to the extracted one or more data element and/or data structures.

In Table 4 an example metadata( ) element is illustrated which includes the element oamd_dyndata_single( ). It is assumed within the example element that the timing-information (oamd_timing_data) is signaled separately. In this case, the element metadata( ) re-uses the timing from the element audio_data_ajoc( ). Table 4 therefore illustrates the principle of re-using "external" timing information.

TABLE 4

| Syntax | No. of bits |
|---|---|
| metadata(b_alternative, b_ajoc, b_iframe, sus_ver) | |
| { | |
| **basic_metadata(sus_ver);** | |
| **extended_metadata(sus_ver);** | |
| if (b_alternative and b_ajoc == 0) { | |
| oamd_dyndata_single(n_objs, num_obj_info_blocks, b_iframe, b_alternative, obj_type[n_objs], b_lfe[n_objs]) | |
| } | |
| tools_metadata_size = **tools_metadata_size_value;** | **6** |
| if (**b_more_bits**) { | **1** |
| tools_metadata_size += **variable_bits(3)** << 7; | |
| } | |
| **dialog_enhancement(b_iframe);** | |
| if (**b_emdf_payloads_substream**) { | **1** |
| **b_emdf_payloads_substream ( );** | |
| } | |
| } | |

In the present document, methods for efficiently encoding metadata of an immersive audio encoder have been described. The described methods are directed at identifying redundant data elements or data structures within different sets of metadata. The redundant data elements in one set of metadata may then be replaced by references to identical data elements in another set of metadata. As a result of this, the data rate of a bitstream of encoded audio objects may be reduced.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

The invention claimed is:

1. A method for encoding metadata relating to N audio objects of an audio scene, with N >1; wherein the metadata comprises a first set of metadata and a second set of metadata;

the first set of metadata is associated with M downmix signals;

the M downmix signals are generated by downmixing the N audio objects; and

M is smaller than N;

the first set of metadata comprises one or more data elements indicative of a property of a downmix signal from the M downmix signals;

a property of a downmix signal describes how the downmix signal is to be rendered by a channel-based renderer;

the second set of metadata comprises one or more data elements which are indicative of a property of one or more audio objects from the N audio objects;

a property of an audio object describes how the audio object is to be rendered by an object-based renderer; and the method comprises identifying a redundant data element which is common to the first and second sets of metadata; and encoding the redundant data element of the first set of metadata by referring to a redundant data element external to the first set of metadata.

2. The method of claim 1, wherein encoding comprises adding a flag to the first set of metadata, which indicates whether the redundant data element is explicitly comprised within the first set of metadata or whether the redundant data element is only comprised within a set of metadata which is external to the first set of metadata.

3. The method of claim 1, wherein the first and second sets of metadata comprise one or more data structures which are indicative of a property of a downmix signal from the M downmix signals and of the one or more audio objects from the N audio objects, respectively;

a data structure comprises a plurality of data elements;

the method comprises identifying a redundant data structure which comprises at least one redundant data element which is common to the first and second sets of metadata; and encoding the redundant data structure of the first set of metadata by referring at least partially to a redundant data structure external to the first set of metadata.

4. The method of claim 3, wherein encoding the redundant data structure comprises encoding the at least one redundant data element of the redundant data structure of the first set of metadata by reference to a set of metadata which is external to the first set of metadata; and/or explicitly including one or more data elements of the redundant data structure of the first set of metadata, which are not common to the first and second sets of metadata, into the first set of metadata.

5. The method of claim 3, wherein encoding the redundant data structure comprises adding a flag to the first set of metadata, which indicates whether the redundant data structure is at least partially removed from the first set of metadata.

6. The method of claim 3, wherein the redundant data element of the first set of metadata is encoded by referring to the redundant data element of the second set of metadata; or of a dedicated set of metadata comprising the redundant data elements; wherein the redundant data element of the second set of metadata is also encoded by referring to the redundant data element of the dedicated set of metadata.

7. The method of claim 3, wherein a property of an audio object or of a downmix signal describes how the audio object or the downmix signal is to be rendered by an object-based renderer.

8. The method of claim 3, wherein a property of an audio object or of a downmix signal comprises one or more instructions to an object-based renderer indicative of how the audio object or the downmix signal is to be rendered.

9. The method of claim 3, wherein a data element describing a property of an audio object or of a downmix signal comprises one or more of:

gain information which is indicative of one or more gains to be applied to the audio object or the downmix signal;

positional information which is indicative of one or more positions of the audio object or the downmix signal in a three dimensional space;

width information which is indicative of a spatial extent of the audio object or the downmix signal within the three dimensional space;

ramp duration information which is indicative of a modification speed of a property of the audio object or the downmix signal; and/or temporal information which is indicative of when the audio object or the downmix signal exhibit a property.

10. The method of claim 3, wherein the second set of metadata comprises one or more data elements for each of the N audio objects; and the second set of metadata is indicative of a property of each of the N audio objects.

11. The method of claim 1, wherein the first set of metadata comprises information for upmixing the M downmix signals to generate N reconstructed audio objects; and the first set of metadata is indicative of a property of each of the M downmix signals.

12. The method of claim 1, wherein the first set of metadata comprises information for converting the M downmix signals into M backward-compatible downmix signals which are associated with respective M channels of a legacy multi-channel renderer.

13. The method of claim 1, wherein the first set of metadata comprises information for enabling the channel-based renderer to determine M positions for M speakers for rendering the M downmix signals, respectively.

14. An encoding system configured to generate a bitstream indicative of N audio objects of an audio scene, with N>1; wherein the encoding system comprises an encoding unit which is configured to generate the bitstream comprising a first set of metadata and a second set of metadata, such that the first set of metadata is associated with M downmix signals;

the M downmix signals are generated by downmixing the N audio objects; wherein M is smaller than N;

the first set of metadata comprises one or more data elements indicative of a property of a downmix signal from the M downmix signals; wherein a property of a downmix signal describes how the downmix signal is to be rendered by a channel-based renderer;

the second set of metadata comprises one or more data elements which are indicative of a property of one or more audio objects from the N audio objects; wherein a property of an audio object describes how the audio object is to be rendered by an object-based renderer; and a redundant data element of the first set of metadata, which is common to the first and second sets of metadata, is encoded by referring to a redundant data element external to the first set of metadata.

15. The encoding system of claim 14, wherein the encoding system comprises a downmix unit which is configured to generate the M downmix signals from the N audio objects; and an analysis unit which is configured to generate downmix metadata associated with a downmix signal from the M downmix signals; wherein the first set of metadata is associated with the downmix metadata.

16. The encoding system of claim 15, wherein the downmix unit is configured to generate a downmix signal from the N audio objects by clustering one or more audio objects.

17. The encoding system of claim 14, wherein the redundant data element of the first set of metadata is encoded by referring to the redundant data element of the second set of metadata.

18. A method for decoding a bitstream indicative of a plurality of audio objects of an audio scene, wherein the bitstream comprises a first set of metadata and a second set of metadata;

the first set of metadata is associated with M downmix signals;

the M downmix signals have been generated by downmixing the N audio objects; and M is smaller than N;

the first set of metadata comprises one or more data elements indicative of a property of a downmix signal from the M downmix signals;

a property of a downmix signal describes how the downmix signal is to be rendered by a channel-based renderer;

the second set of metadata comprises one or more data elements which are indicative of a property of one or more audio objects from the N audio objects;

a property of an audio object describes how the audio object is to be rendered by an object-based renderer; and the method comprises detecting that a redundant data element of the first set of metadata is encoded by referring to a redundant data element of the second set of metadata; and deriving the redundant data element of the first set of metadata from the redundant data element of a set of metadata external to the first set of metadata.

19. A decoding system configured to receive a bitstream indicative of a plurality of audio objects of an audio scene; wherein the bitstream comprises a first set of metadata and a second set of metadata;

the first set of metadata is associated with M downmix signals;

the M downmix signals have been generated by downmixing the N audio objects; and M is smaller than N;

the first set of metadata comprises one or more data elements indicative of a property of a downmix signal from the M downmix signals;

a property of a downmix signal describes how the downmix signal is to be rendered by a channel-based renderer;

the second set of metadata comprises one or more data elements which are indicative of a property of one or more audio objects from the N audio objects;

a property of an audio object describes how the audio object is to be rendered by an object-based renderer; and the decoding system is configured to detect that a redundant data element of the first set of metadata is encoded by referring to a redundant data element of the second set of metadata; and derive the redundant data element of the first set of metadata from the redundant data element of a set of metadata external to the first set of metadata.

* * * * *